US007273192B2

(12) United States Patent
Park

(10) Patent No.: US 7,273,192 B2
(45) Date of Patent: Sep. 25, 2007

(54) CORD-REEL ASSEMBLY FOR ELECTRONIC DEVICES

(75) Inventor: Joung-soo Park, Jeonrabuk-do (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 349 days.

(21) Appl. No.: 11/033,546

(22) Filed: Jan. 11, 2005

(65) Prior Publication Data

US 2005/0224624 A1 Oct. 13, 2005

(30) Foreign Application Priority Data

Apr. 13, 2004 (KR) ..... 10-2004-0025178

(51) Int. Cl.
*B65H 75/30* (2006.01)

(52) U.S. Cl. ..... 242/385.2; 242/375.1; 242/382.3

(58) Field of Classification Search ..... 242/385, 242/385.1–385.4, 375.1, 382.1, 382.3–382.4; 191/12.2 R, 12.4, 12.2 A
See application file for complete search history.

(56) References Cited

U.S. PATENT DOCUMENTS

| | | | | |
|---|---|---|---|---|
| 2,393,138 | A * | 1/1946 | Borkoski | 242/381.6 |
| 2,393,417 | A * | 1/1946 | Ruttkay | 242/381.6 |
| 2,393,511 | A * | 1/1946 | Beede | 242/381.6 |
| 2,428,446 | A * | 10/1947 | Beede | 242/381.6 |
| 2,526,256 | A | 10/1950 | Mihara | |
| 4,948,065 | A * | 8/1990 | Zelmin | 242/381.6 |
| 5,255,768 | A * | 10/1993 | Kasper et al. | 191/12.2 R |
| 5,622,243 | A | 4/1997 | Kang | |
| 5,775,616 | A * | 7/1998 | Sim et al. | 242/353 |
| 5,937,476 | A * | 8/1999 | Kim | 15/323 |
| 6,082,656 | A * | 7/2000 | Thornton | 242/385.4 |
| 6,502,778 | B2 | 1/2003 | Kim | |
| 2002/0008172 | A1 | 1/2002 | Kim | |
| 2002/0126837 | A1 | 9/2002 | Dowsett et al. | |

FOREIGN PATENT DOCUMENTS

| | | |
|---|---|---|
| EP | 0319497 | 6/1989 |
| EP | 0714626 | 6/1996 |
| GB | 2323774 | 10/1998 |
| KR | 1998-043006 | 9/1998 |

* cited by examiner

*Primary Examiner*—Gene O. Crawford
*Assistant Examiner*—Sang Kim
(74) *Attorney, Agent, or Firm*—Ladas & Parry LLP

(57) ABSTRACT

A cord-reel assembly comprises a cord-reel body rotatably installed in the electronic device, a brake member capable of selectively contacting with the cord-reel body, so that the brake member selectively restrains the rotation of the cord-reel body, a manipulation lever having a coupling part connected to the brake member, wherein the coupling part is moved between a first position at which the brake member is contacted with the cord-reel body by the manipulation of the manipulation lever by a user and a second position at which the brake member is spaced from the cord-reel body, a elastic member for elastically biasing the manipulation lever so that the coupling part is moved to the first position, and a damper unit for interfering with the movement of the coupling part in such a way that the returning velocity of the coupling part is delayed when the coupling part is returned from the second position to the first position by the elastic member. With this arrangement, a user does not have to continuously actuate the cord reel until the cord is completely wound.

7 Claims, 4 Drawing Sheets

CORD-REEL ASSEMBLY FOR ELECTRONIC DEVICES

CROSS-REFERENCE TO RELATED APPLICATIONS

This application claims the benefit of Korean Patent Application No. 2004-25178, filed Apr. 13, 2004, in the Korean Intellectual Property Office, the disclosure of which is incorporated herein by reference.

BACKGROUND OF THE INVENTION

The present invention relates generally to an electronic device, and more particularly, to a cord-reel assembly for winding a cord for supplying electric power to an electronic device, which allows the cord to be elastically drawn out from the electronic device.

Prior art cord-reel assemblies comprise a cord-reel body, a manipulation lever, and a brake member that slows and/or locks the cord-reel body.

As is known, the cord-reel member is rotatably installed within an electronic device where it conveniently operates to store a cord within an electronic device. The manipulation lever actuates the cord-reel body brake member to selectively contact or engage with the cord-reel body or the cord, thereby restraining the rotation of the cord-reel body, in which the brake member is installed at a side thereof.

Prior art cord-reel assemblies configured as described above are arranged in such a manner that when a user removes an external force exerted from the manipulation lever, the manipulation lever is restored to its original position by a restoration unit, usually stopping the cord reel before the cord is completely re-wound. If the manipulation lever is restored in this manner, the brake member comes into contact with the cord-reel body or the cord, thereby restraining the rotation of the cord-reel body.

The prior art cord-reel assemblies are therefore deficient in that once the winding of the cord starts, the user has to hold the manipulation lever until the winding is completed. A cord reel that can be actuated once, released and yet fully wind a cord, would be an improvement over prior art cord reels.

SUMMARY OF THE INVENTION

Accordingly, the present invention has been conceived to solve the above-mentioned problems occurring in the prior art, and an object of the present invention is to provide a cord-reel assembly for an electronic device with an improved construction allowing a user to conveniently and simply manipulate the cord-reel assembly for winding a cord.

In order to achieve the above-mentioned object, there is provided a cord-reel assembly for an electronic device comprising a cord-reel body rotatably installed within the electronic device. The cord reel assembly has an actuator that can be operated once and released yet the cord will be completely re-wound. In one embodiment, the cord reel assembly comprises a brake member capable of selectively contacting with the cord-reel body, thereby selectively restraining the rotation of the cord-reel body; a manipulation lever with a coupling part connected to the brake member, wherein the coupling part is moved between a first position at which the brake member is contacted with the cord-reel body by the manipulation of the manipulation lever by a user and a second position at which the brake member is spaced from the cord-reel body; a restoration unit for urging the coupling part to be restored to the first position when the coupling part is in the second position; and a damper unit for interfering with the movement of the coupling part in such a way that the restoring velocity of the coupling part is decreased when the coupling part is restored from the second position to the first position by spring actuated restoration unit.

In the preferred embodiment, the damper comprises an external casing inserted into an axial hole in the manipulation lever. An internal casing installed within the external casing is rotatable in relation to the external casing on a rotary shaft which is the pivotal center of the manipulation lever. An interference fluid fills space between the external casing to interfere with the relative rotation between the internal casing and the external casing. When the cord reel assembly brake member is released, a spring in the cord reel assembly begins to re-wind the cord. The damper slows the engagement of the brake member to the cord reel assembly, allowing the cord reel assembly to re-wind a cord before the brake member re-engages the cord reel.

In one embodiment, the electronic device is a vacuum cleaner body which has a dust collection chamber and contains a vacuum source for generating negative pressure within the dust collection chamber so that dusts on a surface to be cleaned is drawn into the dust collection chamber.

BRIEF DESCRIPTION OF THE DRAWINGS

The above and other objects, features and advantages of the present invention will be more apparent from the following detailed description taken with reference to the accompanying drawings, in which.

DETAILED DESCRIPTION OF THE PREFERRED EMBODIMENTS

Figure 1:
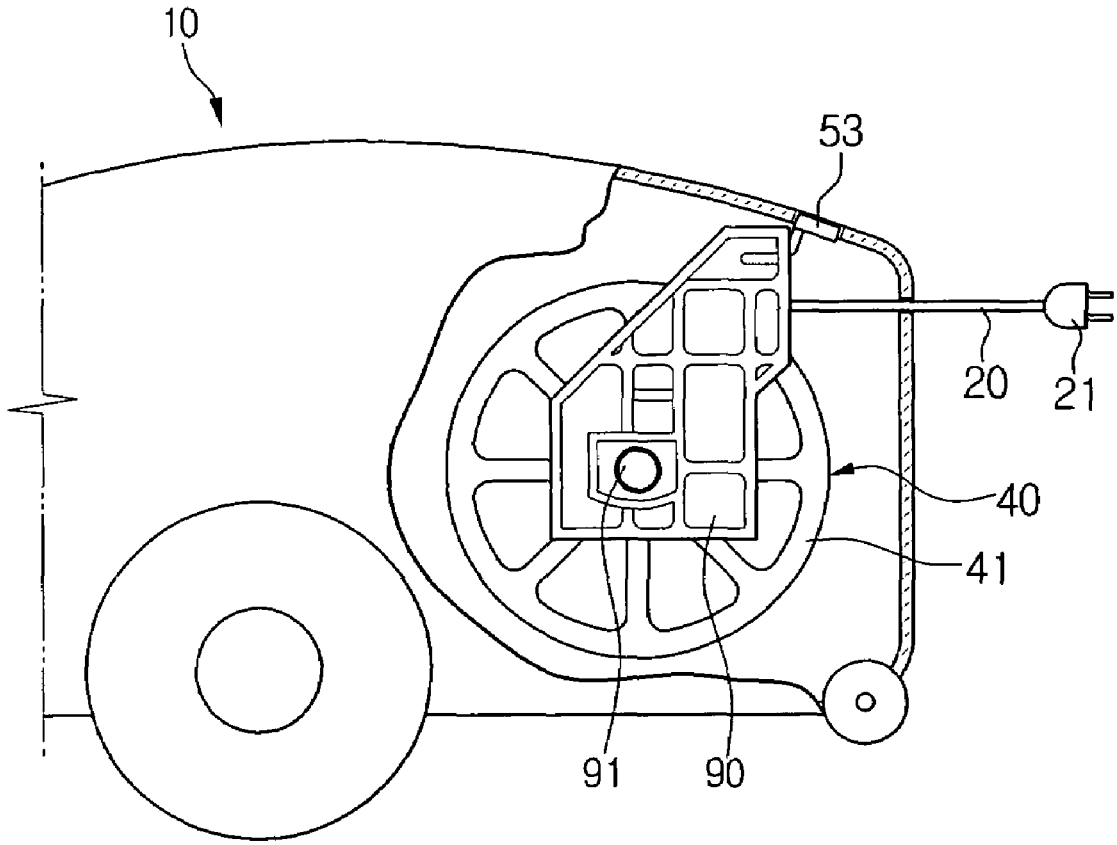
FIG. 1 is a schematic view illustrating a vacuum cleaner as an example of an electronic device employing a cord-reel assembly according to an embodiment of the present invention.

Hereinbelow, embodiments of the present invention will be described in detail with reference to the accompanying drawings.

In the following description, reference numerals are used for the same elements in different drawings. The matters defined in the description such as a detailed construction and elements are only examples and are not to be construed as limiting claim scope. Well-known functions or constructions are omitted for brevity since they might obscure the invention disclosed and claimed herein in unnecessary detail.

FIG. 1 shows part of a vacuum cleaner or other electronic device 10 that is provided with a cord-reel assembly according to an embodiment of the present invention. The cord-reel assembly 40 is installed within the electronic device 10, by which a cord 20 for supplying electric power to the electronic device 10 is selectively and automatically wounded around a cord-reel body 41 on which the cord 20 is stored.

In the drawing, a reel cover 90 supports cord-reel components such as the cord-reel body 41 and a manipulation lever described below. Reference numeral 91 identifies a rotary shaft for the cord-reel body 41. Reference numeral 21 identifies a connector for detachably connecting the cord 20 with an external power source, not shown in FIG. 1.

Figure 2:
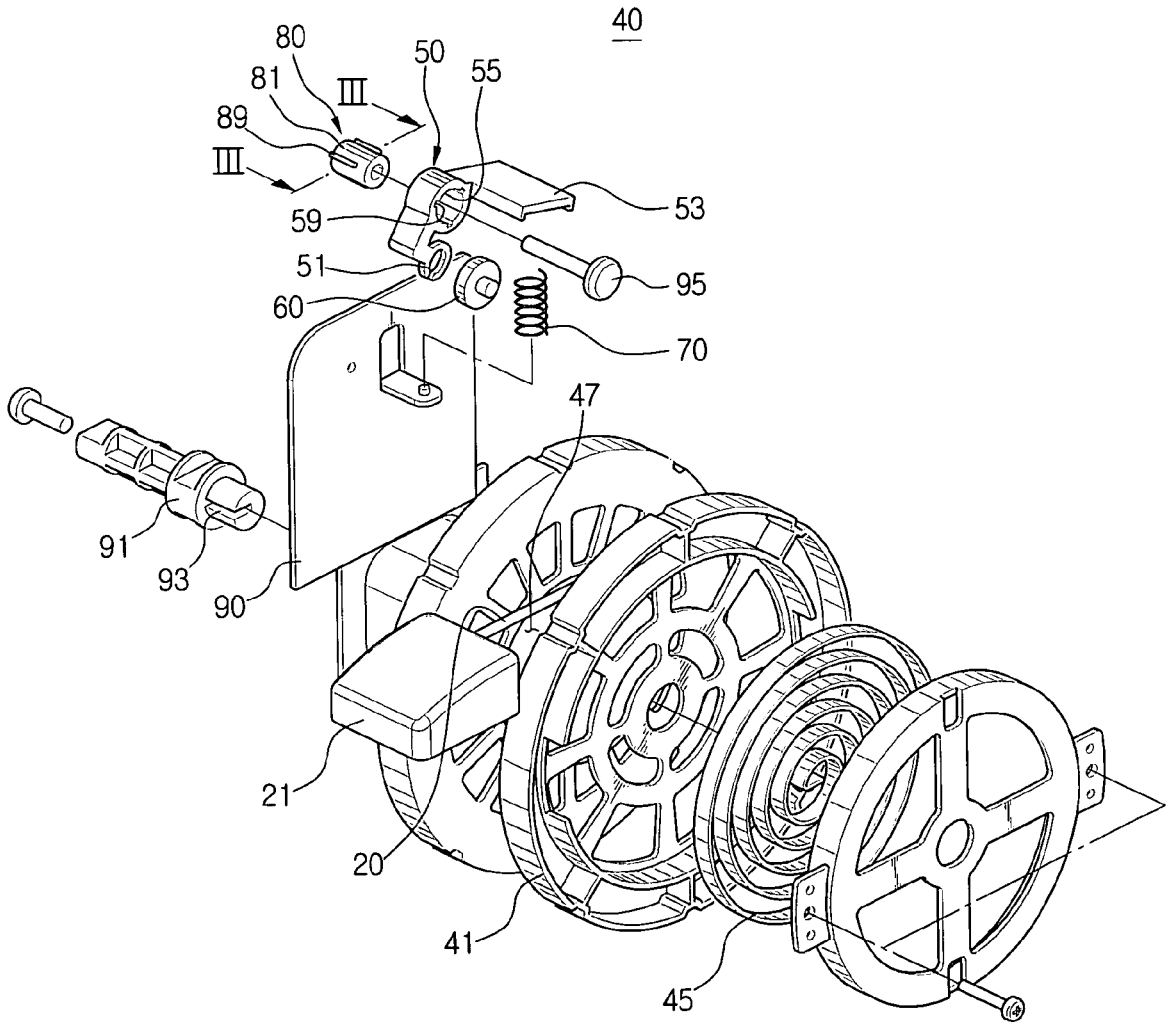
FIG. 2 is an exploded perspective view of the cord-reel assembly according to an embodiment of the present invention.

Referring to FIG. 2, a preferred embodiment of the cord-reel assembly 40 includes the aforementioned cord-reel body 41, a manipulation lever 50, an elastic spring member 70, a brake member 60, and a damper unit 80. The cord-reel body 41 is rotatably supported within the electronic device 10 (see FIG. 1) by the rotary shaft 91 and partially enclosed by the reel cover 90. The cord 20 is wound and unwound around a winding part 47 as the cord-reel body 41 is rotated in one direction or another.

The cord-reel body 41 is elastically biased by a spiral spring 45 so that the cord-reel body 41 is rotated in the direction D (see FIG. 4) for winding the cord 20. The spiral spring 45 is wound as the cord 20 is pulled from the cord-reel body 41.

The inner end of the spiral spring 45 fits within an insertion recess 93 of the rotary shaft 91 thereby engaging the cord-reel body 41 to the rotary shaft 91, through the spring 45. The brake member 60 can frictionally engage and disengage the cord-reel body 41 to disable or enable control rotation of the cord-reel body 41 respectively when the user operates the manipulation lever 50. The brake member 60 is normally spaced away from the cord-reel body 41 allowing the cord 20 to be withdrawn from the cord reel.

The brake member 60 is preferably embodied as a friction roller, however alternate embodiments include using a friction pad.

The manipulation lever 50 comprises a coupling 51 connected or otherwise engaged to the brake member 60, and, a brake activation part 53, which can be selective actuated by the user's to move the brake member 60 away from the cord-reel body 41 when the manipulation part 53 is operated. The manipulation lever 50 in this embodiment is installed in the cord-reel 40 to pivot about the rotary shaft 95. The manipulation lever 50 is elastically biased by the spring member 70 that elastically biases the lower end of the manipulation part 53 upwardly.

A brake member damper unit 80 impedes or slows the restoration of the brake member 60 into contact with the cord-reel body 41 when an actuating force that was applied to the manipulation part 53 is removed. By way of the interference of the damper unit 80, the time between actuation of the manipulation lever 50 to release the brake member 60 and the re-engagement of the brake member 60 to the cord-reel body 41 is lengthened, allowing the manipulation lever 50 to return to its initial position more slowly, which in turn allows the spring 45 more time to fully wind the cord 20. Even if an external force applied to the manipulation lever 53 is removed immediately after the user compresses the manipulation lever 53 to wind the cord 20, the damper unit 80 controls the manipulation lever 50 to slowly return to its original position to assure a sufficient length of time for completely winding the cord 20. For example, if a cord commonly used in vacuum cleaners has a length of 6 m to 7 m, the above-mentioned purpose can be sufficiently achieved when the restoration movement of the manipulation lever 50 is delayed about 3 to 4 seconds required for the damper unit 80 to completely wind the cord 20.

The damper unit 80 in the figures includes a damper 81 at the pivotal center of the manipulation lever 50. With such an arrangement, the space required to install minimized as compared to the space required to install the damper 81 outside of or separate from the manipulation lever 50. Consequently, the entire space for installing the cord-reel assembly 40 does not have to be increased.

Figure 3:
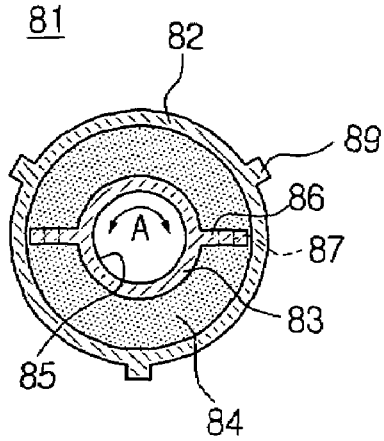
FIG. 3 is a cross-sectional view showing an inside of a damper, taken along the section line III-III of FIG. 2.

Referring to FIG. 3, the damper 81 comprises an external casing 82, an internal casing 83 and an interference fluid 84 between the external casing 82 and the internal casing 83. The external casing 82 is inserted into a first axial hole 55 in the manipulation lever 50 and forms an external circumference surface of the damper 81. The internal casing 83 is provided within the external casing 82 and has a second axial hole 85, into which the rotary shaft 95 is inserted.

The internal casing 83 is bi-directionally rotatable as indicated by the arrow "A" in relation to the external casing 82. A viscous interference fluid 84 is filled into the internal space of the damper 81 defined between the external casing 82 and the internal casing 83. The interference fluid 84 has a predetermined viscosity such that frictional force produced by the fluid's viscosity interferes with and slows the rotation of the internal casing 83 with respect to the external casing 82. A damping effect is thereby provided by the interference fluid 84. A vane 86 integrally formed with the internal casing 83 and having a through-hole 87, allows control of the interference fluid 84 and the damping effect simply by controlling the hole diameter or eliminating it.

As mentioned above, the cord-reel assembly 40 includes an anchoring device for preventing the damper 81 and the manipulation lever 50 from slipping with respect to each other, thereby preventing incorrect transmission of force between the manipulation lever 50 and the damper 81. The anchoring device in the figures comprises at least one anchoring projection 89 preferably embodied as one ore more cuboids (rectangular parallel) projected from the external circumference surface of the damper 81. At least one anchoring recess 59 (see FIG. 2) formed on the internal circumference surface of the first axial hole 88 of the manipulation lever 50 mates with the anchoring projection 89. With this arrangement, the anchoring projections 89 and the anchoring recesses 59 are engaged with each other at the time of connecting the damper 81 and the manipulation lever 50, so that no slip can be produced between the damper 81 and the manipulation lever 50, thereby preventing the damper 81 from incompletely functioning. Although not shown in the drawing, the anchoring recesses and anchoring projections may also be formed between the second axial hole 85 and the rotary shaft 95.

Those of ordinary skill will appreciate that the anchoring device 89 can be embodied using other shapes. Indeed, almost any protuberance and a mating socket will provide an engagement between the damping device 80 and the manipulation lever 50.

In operation, when the cord 20 is drawn out from the electronic device 10 (see FIG. 1) as the electronic device 10 is used, the spiral spring 45 installed within the cord-reel body 41 wound and compressed. Although the cord-reel body 41 tends to rotate along a direction indicated by an arrow D due to the elastic force exerted by the spiral spring 45, its rotation is restrained by the contact between the brake member 60 and the cord-reel body 41.

Figure 4:
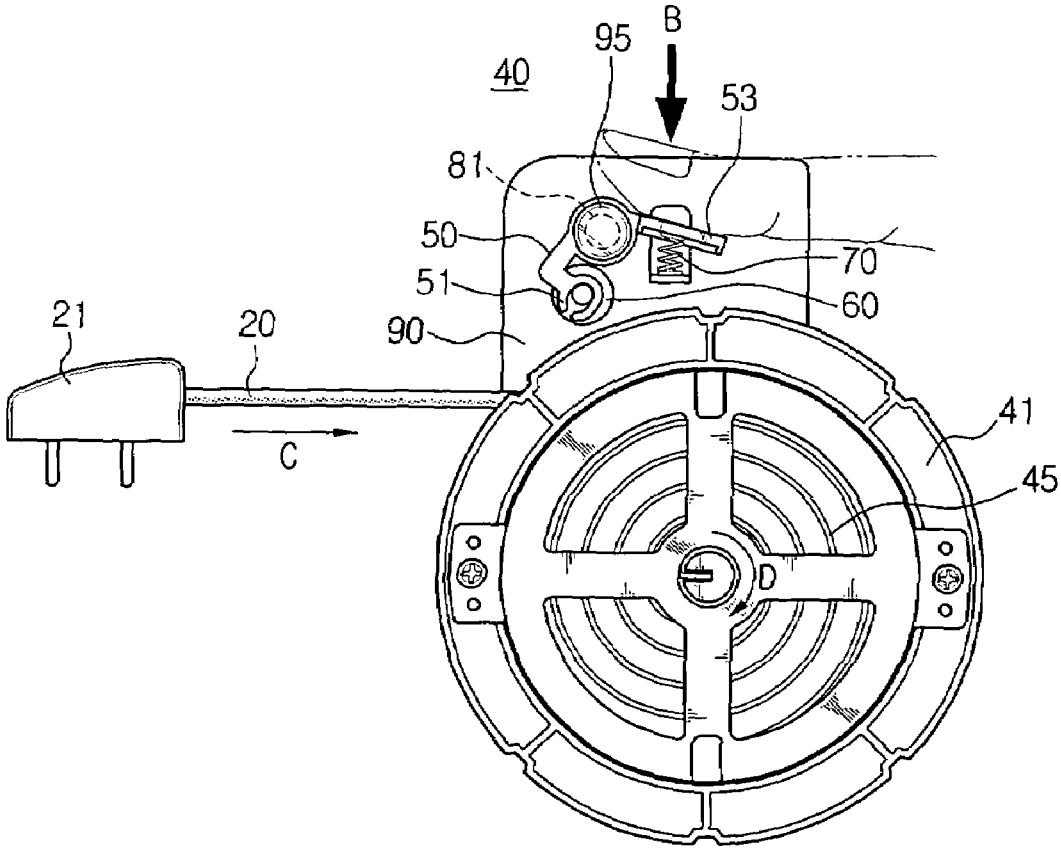
FIGS. 4 and 5 are side views showing examples of using the cord-reel assembly of FIG. 2.

As shown in FIG. 4, if the user compresses the manipulation part 53 of the manipulation lever 50 in a direction indicated by an arrow B to pivot the manipulation lever 50, the brake member 60 is spaced from the cord-reel body 41. Accordingly, the restraint against the cord-reel body 41 by the brake member 60 is released and the cord-reel body 41 is rotated in a direction indicated by an arrow D by the elastic force of the spiral spring 45. As the cord-reel 41 is rotated, the cord 20 starts to be wound around the cord-reel body 41.

Figure 5:
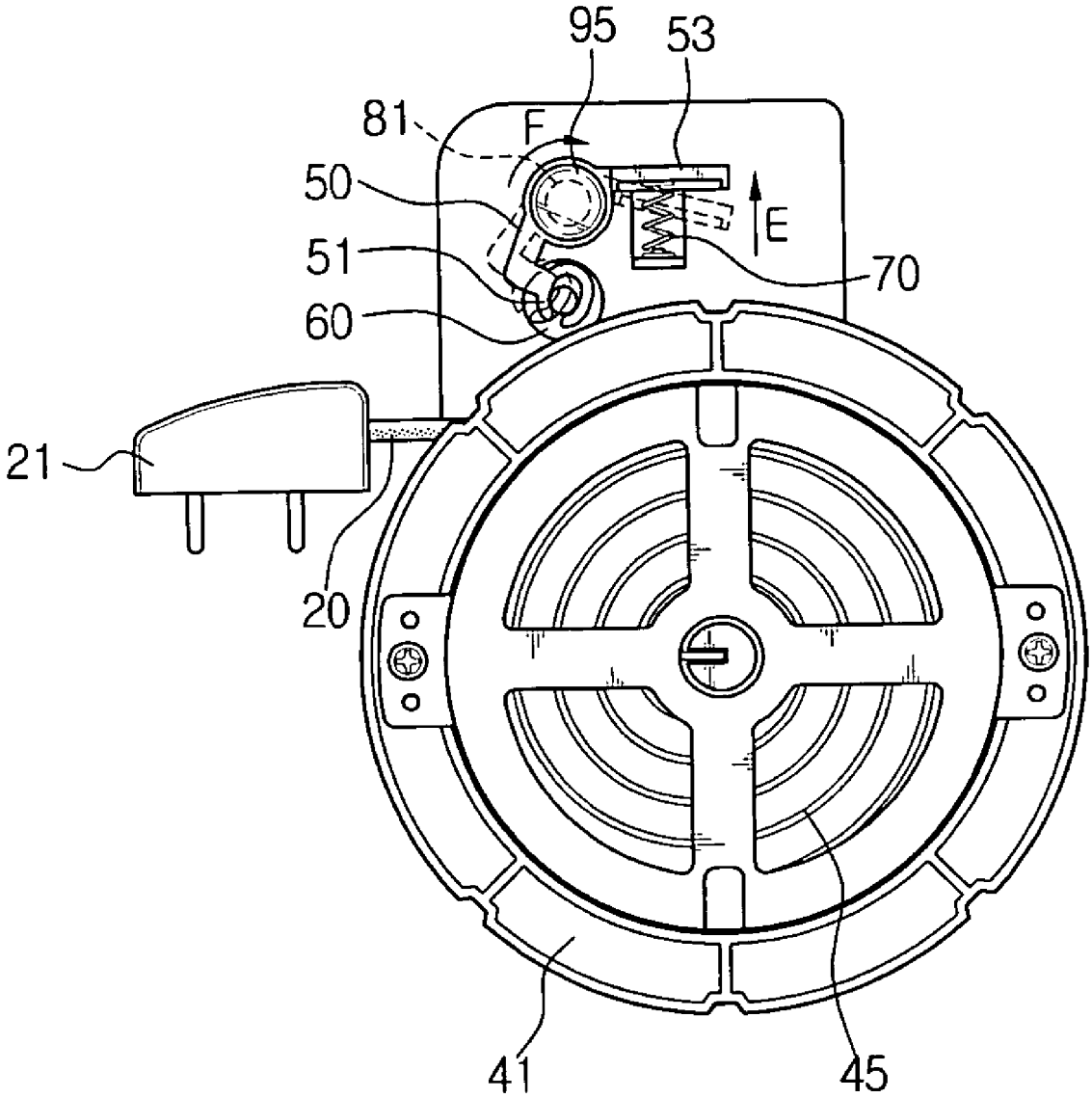

When a user releases the manipulation part 53, the manipulation lever 50 begins to pivot from the state depicted by dotted lines to the state depicted by solid lines along a direction indicated by an arrow E in FIG. 5 by the elastic force of the spring member 70, however, the movement of the manipulation lever 50 is slowed by the aforementioned damper unit 80. Frictional generated along a direction indicated by an arrow F (see FIG. 5) by the viscosity of the interference fluid 84 (see FIG. 3) filled in the interior of the damper 81, interferes with the rotation of the manipulation lever 50. It is preferred that the frictional force generated by the damper 81 be sufficiently small as compared with the elastic force exerted by the spring member 70 for restoring the manipulation lever 50, so that the frictional force by the damper 81 will delay the manipulation lever 50 until the cord 20 is completely re-wound. When the manipulation lever 50 returns, the brake member 60 comes into contact with the cord-reel body 41, thus preventing the rotation of the cord-reel body 41. Consequently, the operation of the cord-reel assembly 40 is completed.

According to the present invention as described above, the returning movement of the manipulation lever 50 is automatically delayed by the damper unit 81. Therefore, it is possible to solve the inconvenience of having to continuously compress the manipulation part until the cord 20 is completely wound. Since the damper 81 is installed on the rotary shaft 95 of the manipulation lever 50 and the pivotal movement of the manipulation lever 50 is interfered by the viscosity of the fluid filled in the interior of the damper 81, the structure of the cord-reel assembly is not complicated due to the installation of the damper 81.

While the preferred embodiments of the present invention have been shown and described with reference to the representative embodiments thereof in order to exemplify the principle of the present invention, the present invention is not limited to the embodiments. It will be understood that various modifications and changes can be made by those skilled in the art without departing from the spirit and scope of the invention as defined by the appended claims. Therefore, it shall be considered that such modifications, changes and equivalents thereof are all included within the scope of the present invention.

What is claimed is:

1. A cord-reel assembly for an electronic device comprising:

a cord-reel body rotatably installed within the electronic device;

a brake member, capable of contacting the cord-reel body, and restraining the cord-reel body rotation;

a manipulation lever rotatably coupled to the brake member, and movable between a first position at which the brake member contacts the cord-reel body and a second position at which the brake member is separated from the cord-reel body;

a restoration spring, operatively coupled to the manipulation lever;

a damper, operatively coupled to the manipulated lever impeding movement of the brake member such that the brake member movement is slowed when the manipulation lever moves from the second position to the first position;

wherein the manipulation lever is installed within the electronic device, and the damper is installed at the pivotal center of the manipulation lever.

2. The cord-reel assembly as claimed in claim 1, wherein the damper comprises:

an external casing inserted into an axial hole provide in the manipulation lever;

an casing installed within the external casing to be relatively rotatable in relation to the external casing and connected to a rotary shaft which is the pivotal center of the manipulation lever; and a viscous interference fluid filled in a space between the external casing and the internal casing to interfere with the relative rotation between the internal casing and the external casing.

3. A cord-reel assembly as claimed in claim 2, wherein the damper further comprises at least one anchoring projection and the manipulation lever comprises a corresponding anchoring recess, whereby the anchoring projection engages the anchoring recess when the damper is engaged with the manipulation lever.

4. A cord-reel assembly as claimed in claim 2, wherein the manipulation lever comprises at least one anchoring projection and the damper comprises a corresponding anchoring recess, whereby the anchoring projection engages the anchoring recess when the damper is engaged with the manipulation lever.

5. A cord-reel assembly as claimed in claim 1, wherein the restoration spring is provided with an elastic member for biasing the manipulation lever to engage the damper.

6. A cord-reel assembly as claimed in claim 1, wherein the manipulation lever comprises a manipulation part exposed to the outside of the electronic device, by which a user can operate the manipulation part.

7. A cord-reef assembly as claimed in claim 1, wherein the electronic device is a vacuum cleaner.

* * * * *